US010954759B1

(12) United States Patent
Keller

(10) Patent No.: US 10,954,759 B1
(45) Date of Patent: Mar. 23, 2021

(54) METHOD FOR INCREASING PRESSURE IN A FLEXIBLE LINER WITH A WEIGHTED WELLHEAD

(71) Applicant: Carl E. Keller, Santa Fe, NM (US)

(72) Inventor: Carl E. Keller, Santa Fe, NM (US)

( * ) Notice: Subject to any disclaimer, the term of this patent is extended or adjusted under 35 U.S.C. 154(b) by 12 days.

(21) Appl. No.: 16/662,502

(22) Filed: Oct. 24, 2019

Related U.S. Application Data

(60) Provisional application No. 62/749,826, filed on Oct. 24, 2018.

(51) Int. Cl.
*E21B 43/10* (2006.01)

(52) U.S. Cl.
CPC ..... *E21B 43/103* (2013.01)

(58) Field of Classification Search
CPC ..... E21B 43/103
See application file for complete search history.

(56) References Cited

U.S. PATENT DOCUMENTS 4,778,553 A 10/1988 Wood
5,176,207 A 1/1993 Keller
5,246,862 A 9/1993 Grey et al.
5,377,754 A 1/1995 Keller
5,520,484 A * 5/1996 Kamiyama ..... B29C 63/36 138/97
5,725,055 A 3/1998 Schirmer
5,803,666 A 9/1998 Keller
5,804,743 A 9/1998 Vroblesky et al.
5,853,049 A 12/1998 Keller
6,026,900 A 2/2000 Keller
6,109,828 A 8/2000 Keller
6,244,846 B1 6/2001 Keller
6,283,209 B1 9/2001 Keller
6,910,374 B2 6/2005 Keller
7,281,422 B2 10/2007 Keller
7,753,120 B2 7/2010 Keller
7,841,405 B2 11/2010 Keller
7,896,578 B2 3/2011 Keller
7,946,359 B2 * 5/2011 Jeffryes ..... E21B 7/20 175/57
8,069,715 B2 12/2011 Keller
(Continued)

OTHER PUBLICATIONS

Keller, C., "Improved Spatial Resolution in Vertical and Horizontal Holes . . . "; Remediation of Hazardous Waste Contaminated Soils; 1994; pp. 513-541; Macel Dekker, Inc.; USA.
(Continued)

*Primary Examiner* — Tara Schimpf
*Assistant Examiner* — Jonathan Malikasim
(74) *Attorney, Agent, or Firm* — Rod D. Baker

(57) ABSTRACT

A method and system to increase or maintain pressure within a flexible liner within a subterranean borehole, such as may be deployed to perform subsurface groundwater sampling. The liner is slightly larger than the borehole and pressurized with an interior fluid pressure so as to urge the liner into intimate contact with the borehole wall. The system and method utilize a weighted "sealing wellhead" assembly placed upon an inverted upper end of the liner. The action force of the sealing wellhead increases or maintains the liner's interior fluid pressure. This method and system are generally practiced with a water-filled liner and with a liner with relatively simple attachments.

7 Claims, 7 Drawing Sheets

(56) References Cited

U.S. PATENT DOCUMENTS

| | | | |
|---|---|---|---|
| 8,176,977 | B2 | 5/2012 | Keller |
| 8,424,377 | B2 | 4/2013 | Keller |
| 9,008,971 | B2 | 4/2015 | Keller |
| 9,534,477 | B2 | 1/2017 | Keller |
| 9,797,227 | B2 | 10/2017 | Keller |
| 10,030,486 | B1 | 7/2018 | Keller |
| 10,060,252 | B1 | 8/2018 | Keller |
| 10,139,262 | B2 | 11/2018 | Keller |
| 10,337,314 | B2 | 7/2019 | Keller |
| 2012/0173148 | A1 | 7/2012 | Keller |
| 2014/0262346 | A1 | 9/2014 | Keller |
| 2014/0262347 | A1 | 9/2014 | Keller |
| 2016/0047225 | A1 | 2/2016 | Keller |
| 2016/0069727 | A1 | 3/2016 | Keller |
| 2016/0348482 | A1 | 12/2016 | Keller |

OTHER PUBLICATIONS

Cherry, J.A., et al.; "A New Depth-Discrete Multilevel Monitoring Approach for Fractured Rock"; Ground Water Monitoring & Remediation; 2007; pp. 57-70; vol. 27, No. 2; USA.

* cited by examiner

PRIOR ART

METHOD FOR INCREASING PRESSURE IN A FLEXIBLE LINER WITH A WEIGHTED WELLHEAD

CROSS-REFERENCE TO RELATED APPLICATIONS

This application claims the benefit of U.S. Provisional Patent Application Ser. No. 62/749,826 entitled "Method for Increasing Pressure in Flexible Liner," filed on 24 Oct. 2018, the entire disclosure of which is hereby incorporated by reference.

BACKGROUND OF THE INVENTION

Field of the Invention

This invention relates to the sealing of a borehole in a geologic formation for numerous hydrologic functions, and more specifically to generating and maintaining pressure within a flexible borehole liner everted into a borehole.

Background Art

A "borehole" is a hole, e.g., a drilled shaft, into the Earth's subsurface. The hydraulic conductivity profiling techniques described in my U.S. Pat. Nos. 6,910,374 and 7,281,422 have been used to map flow zones in over 300 boreholes since 2007. These patents, whose complete teachings are hereby incorporated by reference, describe the flexible liner installation procedure by the eversion process. Other installations of flexible liners into boreholes by the eversion of the liners are used for a variety of subsurface techniques covered by various patents naming this inventor. The methods described in the above patents are generally related to the pressurization of a flexible liner in a borehole.

A flexible liner presents the advantage of sealing a borehole, and isolating numerous devices one from another in the borehole, if the liner interior pressure exceeds the pressure or head of the fluids (typically groundwater) in the surrounding geologic formation. Under certain circumstances, however, the filling of the flexible liner with water is insufficient to obtain an interior liner pressure that exceeds the pressure or head in the surrounding formation. This is the case when the formation water table is very shallow, or when artesian conditions exist in the formation. A common method for increasing the interior head or pressure in the liner is to pour into the liner interior a heavy mud of density greater than about 1 gm/cc. However, the mud column has an increasing head with depth that may exceed the burst pressure of the liner at the liner's lower end portion. A means is needed to pressurize the liner (to a pressure exceeding the pressure head in the formation) uniformly over its complete length (i.e., full depth in the borehole). Such pressurization has been done previously by sealing the top open end of the liner and adding air pressure above the water column within the liner. However, an air-tight seal of the liner is difficult to achieve and maintain, and the air normally diffuses outward through the liner. Alternatively, one can also simply extend the borehole's surface casing a significant distance above the ground's surface, thereby to allow a higher column of water to stand in the liner above the level of the ground. But extending the casing is not possible in many situations, and is undesirable for safety and practical reasons. The method and apparatus disclosed hereinafter allows the application of a uniform overpressure to the entire fluid-filled column inside a flexible borehole liner, while ameliorating or avoiding the above disadvantages.

SUMMARY OF THE INVENTION

There is disclosed herein a method and apparatus to line a borehole with an essentially flexible tubular liner. The liner may be, but is not necessarily, emplaced down the borehole by eversion. The liner is slightly larger than the borehole and is pressurized with an interior fluid pressure so as to urge the liner into intimate contact with the borehole wall. In many applications, the liner interior fluid is water. A system, including a weighted "sealing wellhead" assembly, is placed upon an inverted upper end of the liner. The weight force of the sealing wellhead acts to increase/maintain the liner's interior fluid pressure. A hanging weight and weight tether assembly may be engaged with a sheave or pulley connected to the bottom end of the sealing wellhead, with the weight tether attached to a closed bottom end of the liner, to supplement the effect of the sealing wellhead upon the upper end of the liner. The invention generally is practiced with a water-filled liner and with a liner with relatively simple attachments.

BRIEF DESCRIPTION OF THE DRAWINGS

The attached drawings, which form part of this disclosure, are as follows.

The figures are not necessarily to scale, either between views or within a single view.

DESCRIPTION OF THE INVENTION

Figure 1:
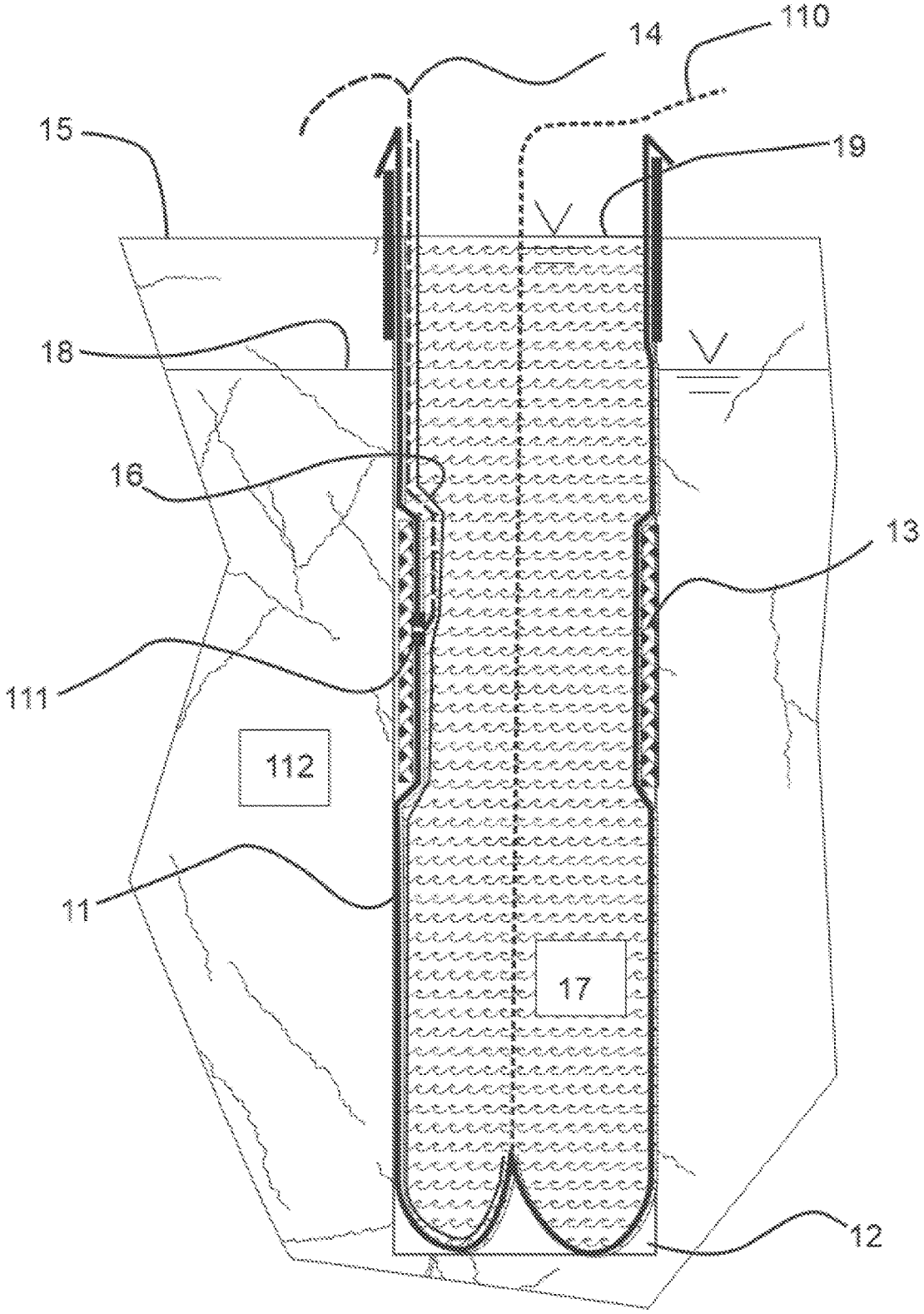
FIG. 1 is side sectional view of an everting liner emplaced in a borehole below the surface of the ground.

A typical flexible liner method and apparatus is shown in FIG. 1. A borehole 12 is defined in the ground below the ground's surface 15. The overall system and apparatus include a strong flexible liner 11, which during and after eversion down a subsurface borehole 12 is pressed against the generally cylindrical wall of the borehole by the higher pressure (head) within the interior 17 of the liner 11; water is added to the liner interior 17 during eversion. The higher pressure head is due to the fact that a water level 19 within the liner is above the ambient water level 18 in the geologic formation 112 surrounding the borehole 12. It is immediately noted, however, that the present invention may be practiced with most flexible liners for lining a borehole, whether the liner is emplaced by eversion or by some other technique.

The pressurized liner 11 when pressed against the borehole wall seals the borehole 12 against vertical flow within the borehole, and isolates an exterior spacer 13 from one or more other (similar) spacers provided on the same liner. Typically, the liner 11 incorporates numerous sampling intervals and tubes. As seen in FIG. 1, a spacer 13 is disposed on the outside of the liner 11, between the liner and the borehole wall. Also shown in FIG. 1 are the sample tubing 14 and port 111 incorporated in the liner design for the purpose drawing a water sample from the spacer 13. The spacer 13 is in fluid communication with an associated sample tube 14 via the port 111 in the liner 11.

Ambient fluid (e.g., groundwater) from the surrounding formation 112 is sealed against entering the borehole 12 by the presence of the flexible liner 11. Fluid from the formation 112 flows to and through the spacer 13, through the liner port 111, and then into the tube 14. Sampled fluid may then be pumped to the surface 15, via the sample tube 14, for testing and evaluation. The sample tubing 14 between the ground's surface 15 and the port 111 preferably is contained in an interior sleeve 16 welded to the liner's interior surface. As mentioned, the liner 11 normally incorporates numerous sampling intervals (and associated spacers with corresponding discrete sampling tubes). A main tether 110 within the interior of the everted liner 11 is attached to the bottom end of the liner, and is used to invert the liner during removal of the liner from the borehole 12.

The ability to seal the borehole 12 depends on the pressure within the interior 17 of the liner 11 exceeding the exterior pressure (e.g. formation head) on the outside of the liner. The differential pressure (between the interior 17 of the everted liner and the liner exterior) must be directed outward, thereby to cause the dilation of the liner 11. There are various hydrologic situations that affect that differential pressure.

Figure 2:
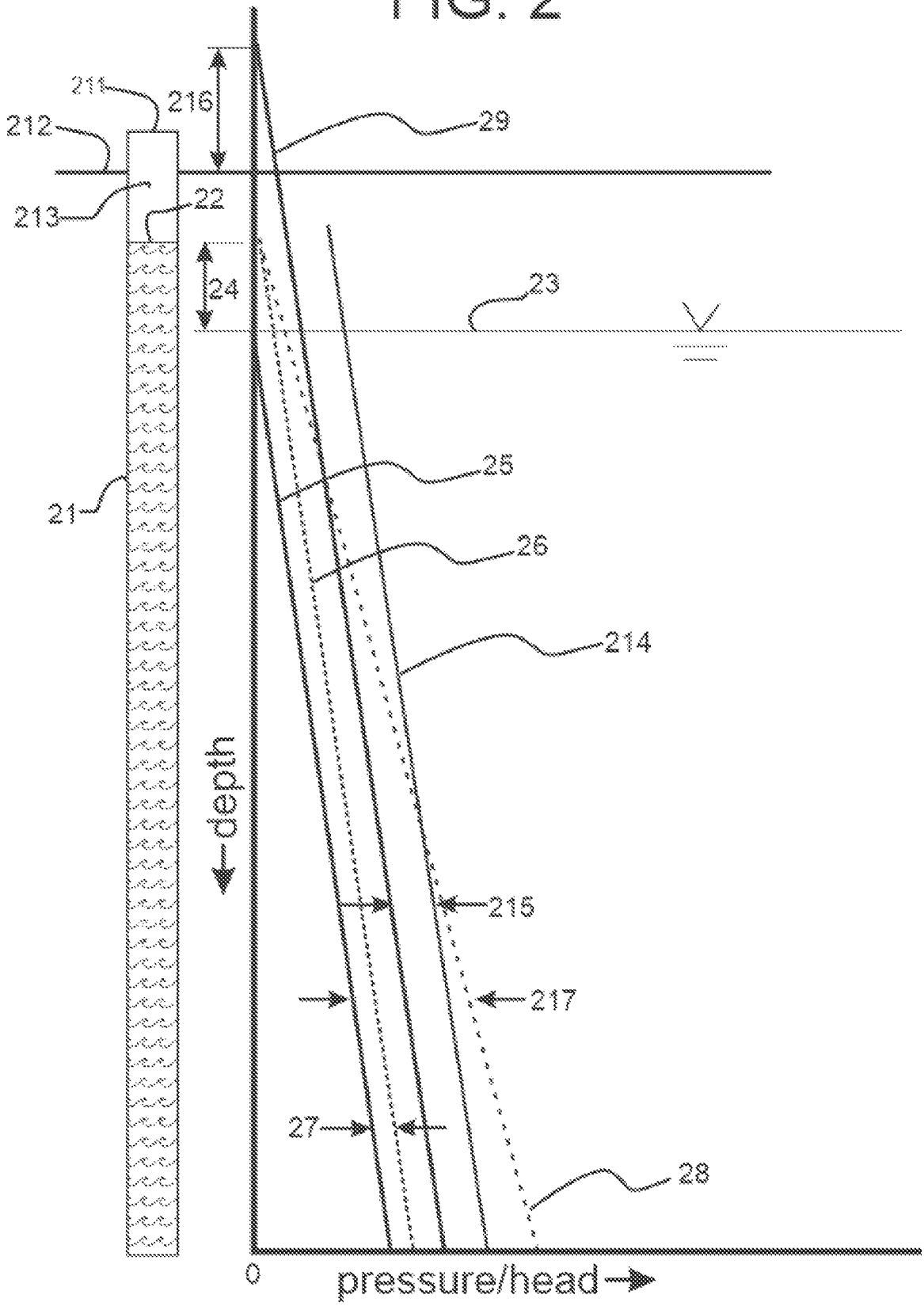
FIG. 2 is diagrammatic graph plotting the interior head (by depth) of a borehole liner filled with a variety of fluids under a variety of hydrologic conditions.

Attention is invited to FIG. 2, illustrating graphically the pressure, as a function of depth, in the liner and in the surrounding geologic formation (e.g., of FIG. 1) In FIG. 2, depth (relative to ground surface level) is represented on the vertical y-axis, and pressure is plotted on the x-axis. Reference is made to FIG. 2 for the labeled numbered differential pressures on the graph. Initially, the liner 21 can have the same water level 22 inside the liner relative to the surface 212 as the water level 23 in the formation. In that case, the differential pressure inside the liner 21 relative to the formation pressure 23 is zero. Raising the water level in the liner 21 by a higher level 24 increases the differential pressure on the liner against the borehole wall, because the borehole wall is at the formation pressure. The normal pressure gradient in the formation is shown as the formation curve 25 with a slope of about 0.433 psi/ft. Raising the water level in the liner to higher level 24 simply raises the first formation curve 25 to a liner excess pressure curve 26 for the pressure inside the liner, so that the pressure difference 27 between the two pressure curves is the liner pressure difference from the first formation pressure 25 at any depth in the liner. If that pressure differential 27 exceeds 5 feet of head, the liner seal against the borehole wall is adequate for most situations.

If the pressure differential 27 is not sufficient to seal the liner against the borehole, a heavy mud can be added to the liner interior. However, that mud produces an increased pressure (per mud curve 28) inside the liner versus depth. The pressure difference 217 between the first formation fluid pressure curve 25 and the mud curve 28 increases with depth. The increasing differential pressure with depth on any unsupported portion of the liner 21 may exceed the strength of the liner causing the liner to rupture or burst. It is also noted that at shallow depths, the differential 217 between the first formation curve 25 and the mud curve 28 may be so small as to not be an effective differential pressure for sealing the borehole. This may be the case for a water table 23 near the surface 212.

If the water table 23 is near the surface 212, or the formation contains an aquifer with an artesian head that is a high level 216 above the surface (e.g., a spring flowing out of the surface), the normal excess head 26 in the liner 21 will not seal the borehole. In FIG. 2, the artesian pressure with the depth curve 29 has a pressure with depth that exceeds the liner interior pressure (e.g., excess pressure curve 26). The artesian pressure 29 being greater than the liner interior pressure per curve 26 will collapse the liner 21. There is therefore a need to increase the liner pressure (per curve 214) to exceed the artesian pressure (per curve 29) at all depths. It is desirable that this greater liner interior pressure 214 be sufficiently high as to exceed any artesian head 29 by an amount 215 sufficient to seal the borehole.

To increase liner interior pressure, it is known to seal the top of the liner 211 and then add an increase in the air pressure (in the volume 213 above the water level 22 inside the liner) to exert pressure against the water column within the liner. But the air-tight seal of the top end 211 of the liner 21 (which seal usually has various functional penetrations) is costly and difficult to maintain. Moreover, the interior air tends to diffuse radially outward through the liner, thereby reducing over time the pressure within the liner. The present system and method allow an increase the pressure in the liner 21 uniformly along the length of the liner, without the need to maintain a high air pressure above the water level inside the liner. Thus, the present invention allows one to increase the pressure in the liner uniformly along the full length of the liner, as illustrated by the curve 214, without the need to develop an air-tight seal at the top 211 of the liner. The ideal pressure with depth curve 214 exceeds the artesian pressure 29 by a differential amount 215 along the entire length of the liner.

Figure 3:
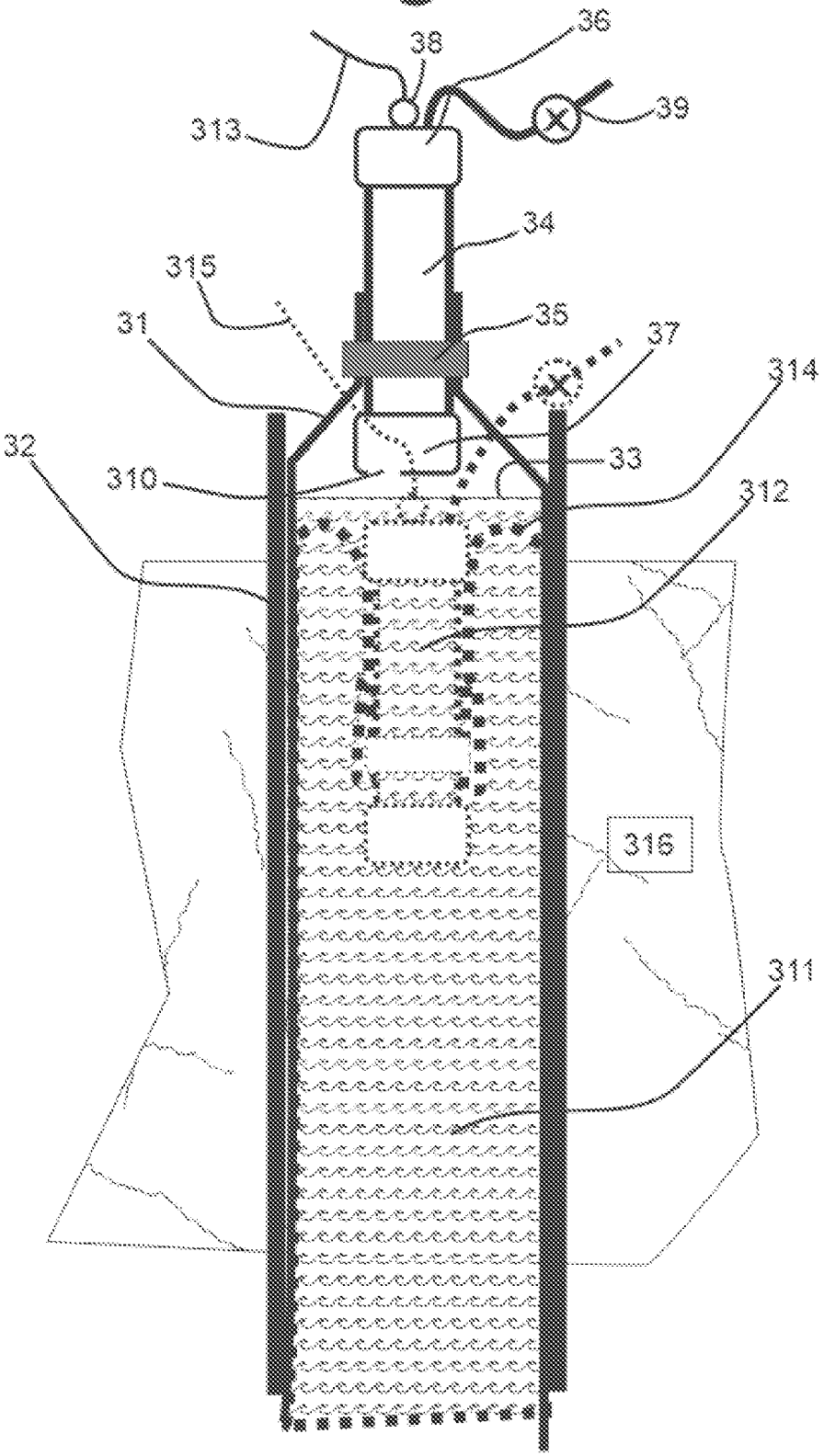
FIG. 3 is a side sectional view of a system and apparatus according to the present invention, as conceived to pressurize a water-filled liner within a subsurface borehole.

FIG. 3 illustrates the geometry of one embodiment of the present system and method for maintaining a uniform differential pressure with depth in a water filled liner, without concern about minor leakage from the liner. The uniform pressure will not threaten the liner integrity with increasing depth as with the mud fill. Also, a mud fill is a nuisance to mix and install in a liner. In FIG. 3, a "heavy sealing wellhead" 34 assembly and its sealed connection 35 to the top end of the liner 31 are shown in a first position depicted in solid lines, and a second or subsequent position is depicted using phantom lines.

Once the liner 31 is in place in the borehole 32 and filled with water 33, the top open end of the liner 31 can be gathered around the heavy sealing wellhead 34 and clamped 35 or otherwise securely sealed to the wellhead 34 with a water-tight seal. This first position of the system is shown in solid lines in FIG. 3. The heavy sealing wellhead 34 may be composed of a heavy walled iron pipe with interior weight added as needed to adjust the weight. The top 36 and bottom 37 of the sealing wellhead 34 are closed with caps. An eye bolt 38 is attached to the top 36 of the sealing wellhead 34, and a valved water addition tube 39 is provided for adding water to the interior of the sealing wellhead. A hole 310 in the bottom 37 of the wellhead 34 allows water to flow through the water addition tube 39 and valve, through the sealing wellhead, and into the interior 311 of the liner 31. A valve in the addition tube 39 is used to control the flow of water (via the sealing wellhead) into or out of the liner 31 beneath the sealing wellhead 34.

The heavy sealing wellhead 34 then is lowered to a new position 312 (shown in phantom lines) using the main tether 313 attached to the eyebolt 38. After such lowering, the liner 31 inverts to a new position and shape 314 as the heavy sealing wellhead 34 descends into the water 33; water flows up and out from the tube 39 as the wellhead 34 fills with water in its new position 312. The sealing wellhead 34 is allowed to descend, and the valve in the tube 39 is closed. The inversion of the liner 31 to its second configuration 314 decreases the volume in the liner interior 311 due to the liner's new shape 314, and the water pressure in the liner interior 311 rises (when the valve in the 39 is closed). At that time, the pressure inside the liner depends on the well-known equation, $T=\frac{1}{2}A\,\Delta P$, where T is the tension on the inverted liner 314 (in this case, T is the weight of the heavy sealing wellhead 34), A is the cross section of the liner 31 in its new configuration 314, and $\Delta P$ is the differential pressure across the end of the newly inverted liner. The sealing wellhead 34 descends until the pressure differential $\Delta P$ across the upper end of the inverted liner (new configuration 314) is sufficient to support the weight of the sealing wellhead 34. The greater the weight of the sealing wellhead 34, the greater the pressure inside the liner interior 311.

After the liner interior pressure is supporting the heavy sealing wellhead 34 atop the liner, the loosely coiled main tether 313 can be tied to a support at the top of the well (not shown). The loose coils of the main tether 313 allow the heavy sealing wellhead 34 (second position 312 shown in phantom lines) to descend if there is leakage from the liner. If the liner 31 is leaking at a slow rate, the heavy sealing wellhead 34 descends still further to maintain the liner interior pressure sufficiently to support the weight of the sealing wellhead. If needed, the regulated addition of water through the water addition tube 39 increases the pressure in the liner interior 311, causing the upper end of the liner 31 to evert upwards, thereby lifting the sealing wellhead 34 to a height desired (such as its first elevational position shown in solid lines in FIG. 3). Closure of the valve in the addition tube 39 then maintains this increased elevation of the sealing wellhead 34. This simple inverted liner 31 and heavy sealing wellhead 34 then maintain an overpressure in the liner along its entire length. With a sufficient weight applied by the sealing wellhead 34, the liner interior pressure exceeds the formation pressure to maintain a good seal of the liner against the borehole wall. This mechanism is especially useful for shallow water tables and for artesian formation pressures.

Figure 4:
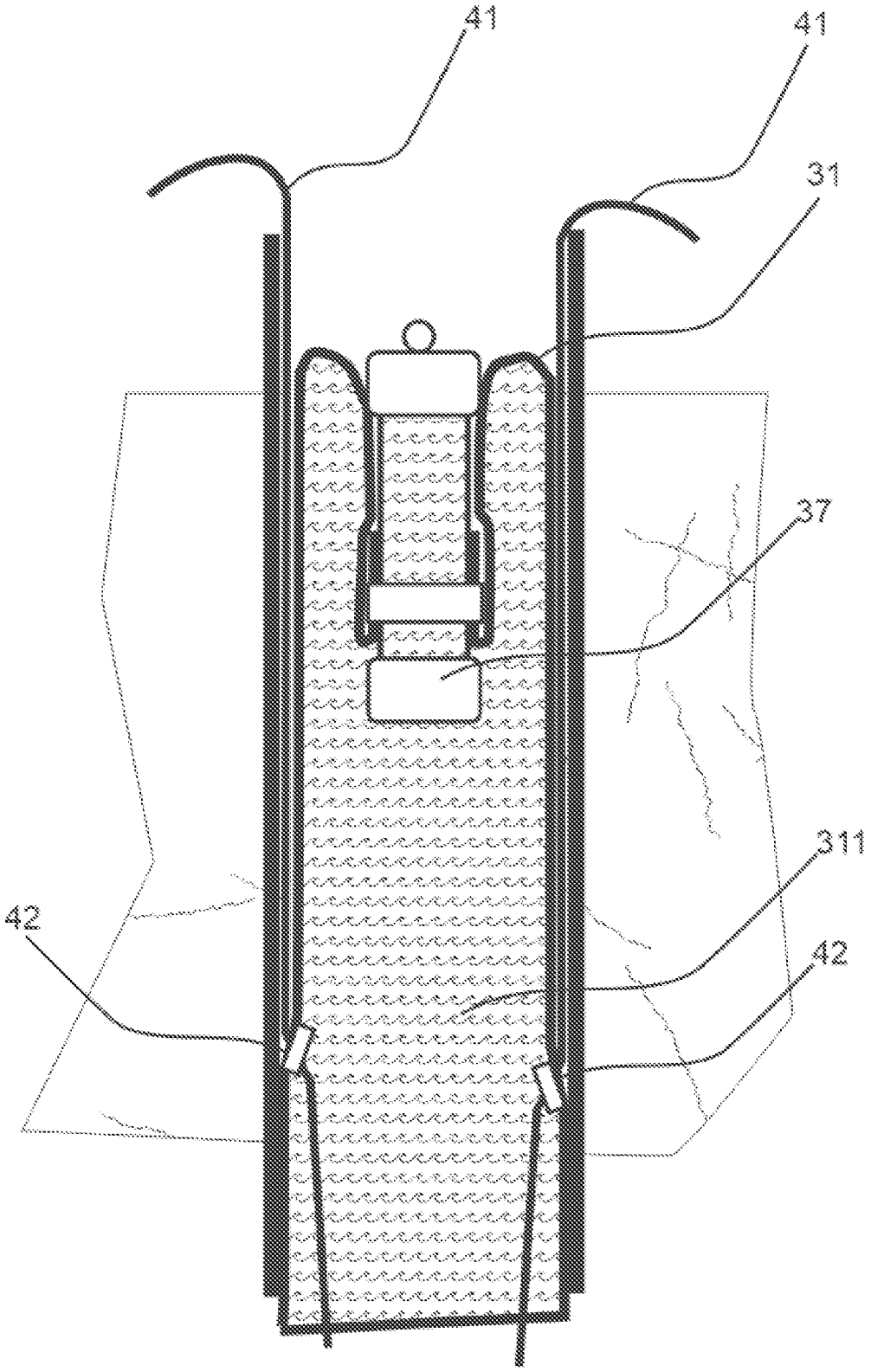
FIG. 4 is a side sectional view of the system and apparatus according to FIG. 3, showing a mode for routing of interior tubing to the exterior of the liner.

If the liner 21 contains interior sampling tubing 24 as illustrated in FIG. 1, the tubing will interfere with the seal between the liner and the heavy sealing wellhead. FIG. 4 illustrates a liner 31 with the sealing wellhead, including its bottom 37, resting atop, and weighing thereon, to maintain overpressure in the liner interior 311. Sample tubes 41 are routed from the interior 311 of the liner 31, through sealed feed-throughs 42 in the liner 31, to the exterior of the liner. With such routing of the tubes 41, the liner 31 is easily sealed to the heavy sealing wellhead 34. In that case, the heavy sin wellhead 34 can still descend to accommodate any leakage from the water-filled liner interior 311, to maintain the pressure inside the liner.

Figure 5:
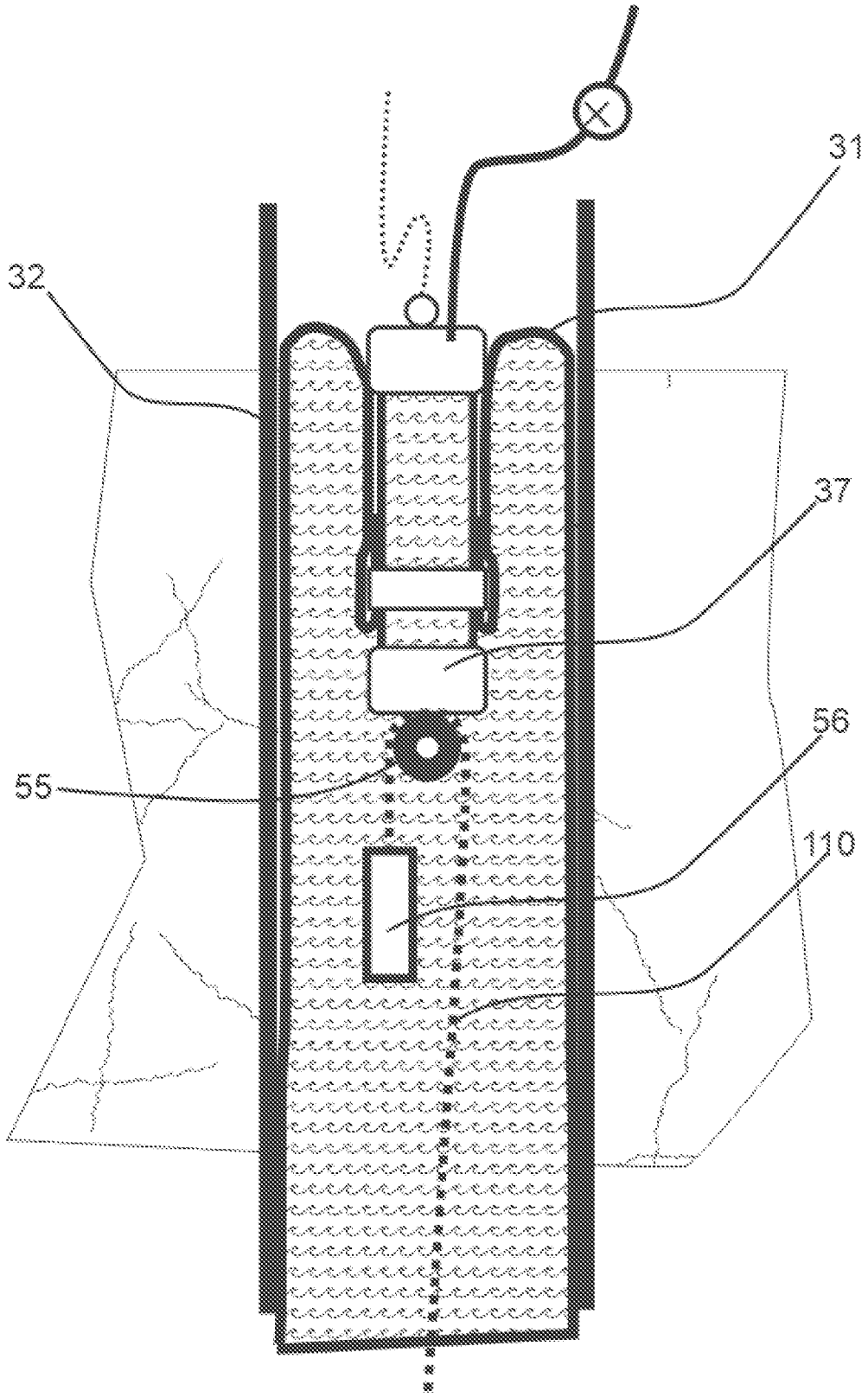
FIG. 5 is a side sectional view of a system and apparatus according to the present invention, illustrating a preferred but optional use of an augmenting hanging weight supported by the commonly deployed tether of a liner.

FIG. 5 depicts a preferred but optional enhancement of the apparatus and system, using the interior weight tether 110 (e.g., of FIG. 1) to increase the effective weight of a sealing wellhead 34. A weight tether 110 attached to and extending from the inverted bottom end (shown in FIG. 1) of the liner 31 is threaded through a sheave 55 attached to the bottom of the heavy sealing wellhead 34. A separate hanging weight 56 is attached to the other end of the weight tether 110. Before the liner 31 is clamped or otherwise sealed to the sealing wellhead 34, the weight tether 110 is routed through the sheave 55 and connected to the hanging weight 56. Care is exercised to minimize the air trapped inside the liner 31 when the liner is sealed to the sealing wellhead 34. Thus, as the sealing wellhead 34 is lowered as described hereinabove, the hanging weight 56 likewise descends to maintain the tension (due to the weight 56) on the weight tether 110, and a downward force is applied on the sheave 55 equal to twice the weight of the hanging weight 56. In this manner, the tether 110 is used to enhance the downward force of the heavy sealing wellhead 34.

It is noted that the tension in tether 110 due to the hanging weight 56 on the sealing wellhead 34 is twice the tension on the bottommost end of the inverted liner. The top end of the liner 31 is inverted, as seen in FIG. 5, by the heavy sealing wellhead 34 plus the tension in the tether 110, which increases the pressure within the liner 31 throughout its length. The pressure increase causes an increase in the differential pressure on the liner 31, improving the seal of the liner 31 against the borehole wall 12. As the weights are great enough, the liner's interior pressure exceeds an artesian pressure in the formation, thus preventing liner collapse. A further advantage of this system is that the weight tether 110 thus is supported (from the sealing wellhead) in the borehole accessible for the liner 31 removal by inversion.

Figure 6:
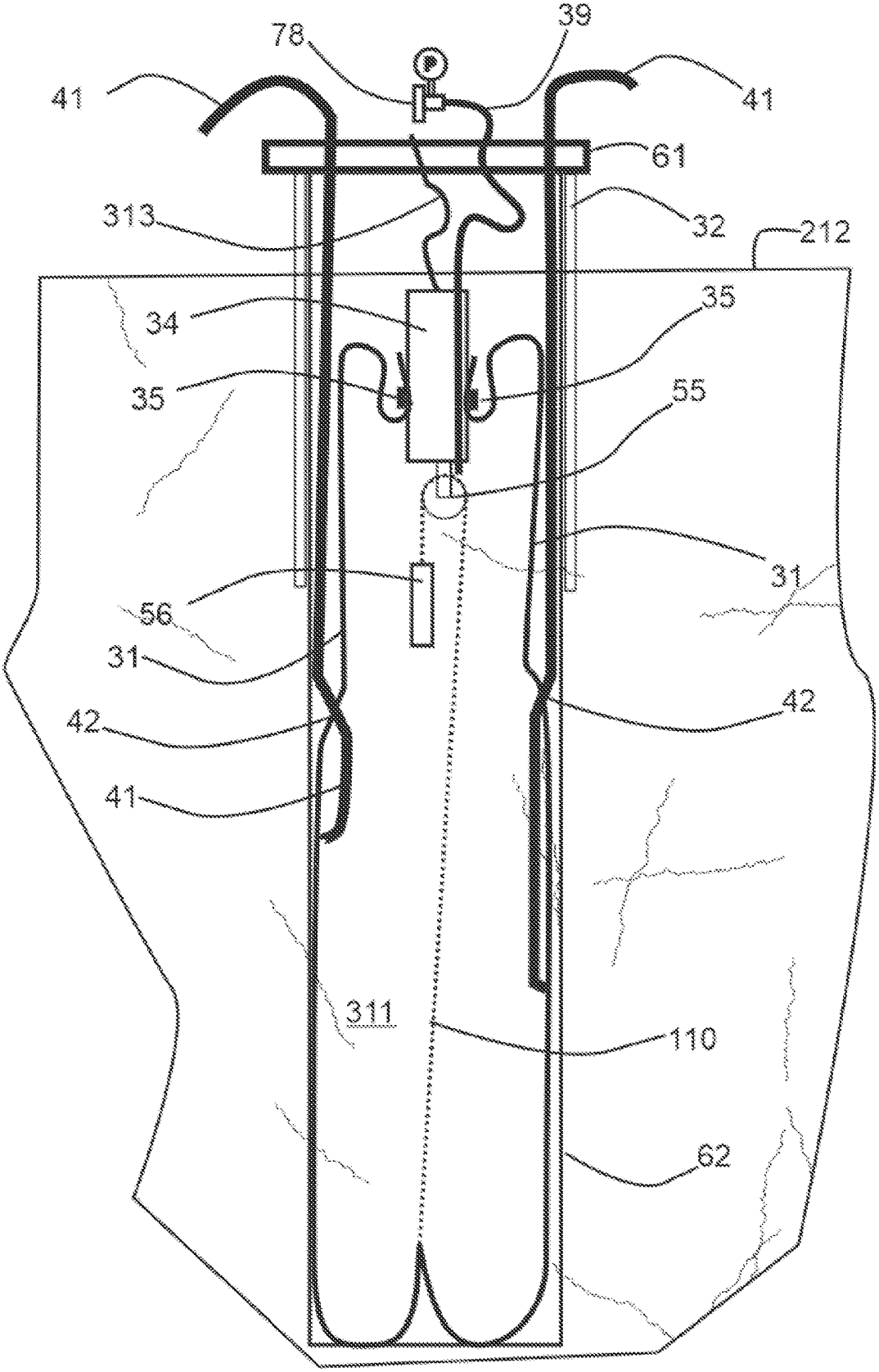
FIG. 6 is a side sectional view of a system according to the present disclosure, disposed down a subsurface borehole, showing the system at a first configuration for augmenting the excess head in a water-filled borehole liner.

FIG. 6 further illustrates an embodiment, and the principles, of the system and method according to the present invention, for increasing the pressure within the liner 31 to a target pressure exceeding that obtainable by simply filling the liner to the level of the surface 212. The liner 31 optionally may be everted into the borehole 62 by placing a short length (modest volume) of heavy mud (not shown in FIG. 6, but known in the art) into the liner interior 311 to aid the eversion by increasing the pressure against the (lower) everting end of the descending liner. (As mentioned previously, extending the liner 31 above the ground's surface 212 is a known alternative method for applying a higher pressure in the liner to exceed the head (level 23 in FIG. 2) in the surrounding formation, to allow the liner to be everted into place down the borehole 62.)

Continued reference is made to FIG. 6. After the liner 31 is in place within the bore 62, the open top end of the liner is gathered into contact around the heavy sealing wellhead 34 and sealed, as with a clamp 35 or suitable alternative, securely to the outside circumference of the sealing wellhead 34. Again, caution is advisably exercised to minimize the amount of air trapped inside the liner interior 311 when the liner 311 is sealed to the sealing wellhead 34. The sealing wellhead 34 may be a steel-walled pipe with weight(s) supplied within the pipe interior. The top and bottom ends of the heavy sealing wellhead 34 are sealed closed. A safety tether 313 is securely connected to the top of the sealing wellhead 34. The safety tether 313 extends upward from the sealing wellhead 34 to a reliable connection to the top of the hole casing 61, and is used to controllably lower (and raise, if needed) the sealing wellhead 34. It also acts as a security to prevent the sealing wellhead 34 from accidentally descending more than a predetermined distance below the top of the casing 32 in the rare event of a catastrophic emptying of water from the liner interior 311. Thus, during normal operation of the system and method to automatically maintain liner pressure, the safety tether 313 is slack and bears little or no tension; only when the sealing wellhead 34 is being operably raised or lowered, or falls a predetermined distance (approximating the length of the safety tether 313) down the borehole 62 to a preselected limit, does the safety tether 313 become taut, to prevent further uncontrolled descent of the sealing wellhead 34.

The water addition tube 39 is extended from above ground, and connection thereof to the sealing wellhead 34 is provided for adding water to (or optionally pumping water from) the inside of the walled pipe of the sealing wellhead 34. The sheave or pully wheel 55 is attached to the bottom of the sealing wellhead 34. One or more holes are defined through the pipe of the sealing wellhead 34 to allow water to flow through the water addition tube 39, into and out of the inside of the wellhead pipe, and thus to (or from) into the interior 311 of the liner 31 beneath the sealed 35 top of the liner. FIG. 6 shows that alternatively the water addition tube 39 may be extended through apertures in the top and bottom of the sealing wellhead 34. Water thus can be added/extracted to/from the liner interior 311, via the sealing wellhead 34, by means of the water addition tube 39 from the surface.

Supplementing the disclosure of FIG. 5, FIG. 6 shows the weight tether 110 has a first end securely attached to the inside of the bottom end of the liner 31, and a second free end. The weight tether 110 is securely attached to, and extends from, the inverted bottom end of the liner 31. The weight tether's second end is threaded through and over the sheave 55, and the hanging weight 56 is attached to this second end of the weight tether 110. The hanging weight 56 is allowed to hang from the sheave 55 and within the liner interior 311. The hanging weight 56 thus is movable up and down by the rotation of the sheave 55 as the weight tether 110 moves through/over the sheave 55. A sheave or pulley is preferred for use, but it is to be understood that a simple eyebolt or other looped structure secured to the bottom of the sealing wellhead 34 may serve as a functional alternative to a sheave, in which case the weight tether 110 is simply slidably disposed thought the eye of the bolt or other looped structure. In this disclosure and in the claims, "sheave" shall include such another looped structure. The liner interior 311 is filled with water to the surface 212 via the water addition tube 39. The heavy sealing wellhead 34 is then lowered partially into the liner interior 311, and the liner 31 is clamped/sealed 35 to the outside surface of the sealing wellhead 34. When the sealing wellhead 34 is lowered further, the hanging weight 56 also descends (at a rate approximately twice to the rate of descent of the sealing wellhead) to maintain the tension in the weight tether 110, and to assert a downward force on the sheave 55 equal to twice the hanging weight 56.

The effect on the upper end of the liner 31 of the heavy sealing wellhead 34 and of the hanging weight 56 (via the sheave on the sealing wellhead) is similar to the tension on the bottom end of the liner 31 due to the tension in the weight tether 110. As was discussed in reference to FIG. 3, the closed and sealed top of the liner 31 thus is inverted by the downwardly moving heavy sealing wellhead 34, which raises the pressure in the liner interior 311 throughout the length of the liner 31. This resulting pressure increase causes an increase in the differential pressure across the liner 31, thus improving the seal of the liner against the inside wall of the borehole 62. With sufficient weight(s) in the sealing wellhead 34 and hanging weight 56, the pressure within the liner interior 311 can exceed an artesian pressure in the formation surrounding the borehole, preventing liner collapse. During the lowering of the sealing wellhead 34, a valve 78 on the water addition tube 39 is closed to prevent water loss (via the tube 39) from within the liner.

It is noted that the pressure within the liner interior 311 may be modulated by the operator's controlled actuation of the valve 78 and pump (not shown) that are in communication with the water addition line 39. Addition of water via the line 39 increases liner interior pressure, which may have the effect of maintaining or increasing the elevation of the heavy sealing wellhead 34. Similarly, water escaping the liner interior 311, as by leakage or deliberately by opening the valve 78 (and perhaps actuating the pump), may have the effect of lowering the elevation of the heavy sealing wellhead 34.

Figure 7:
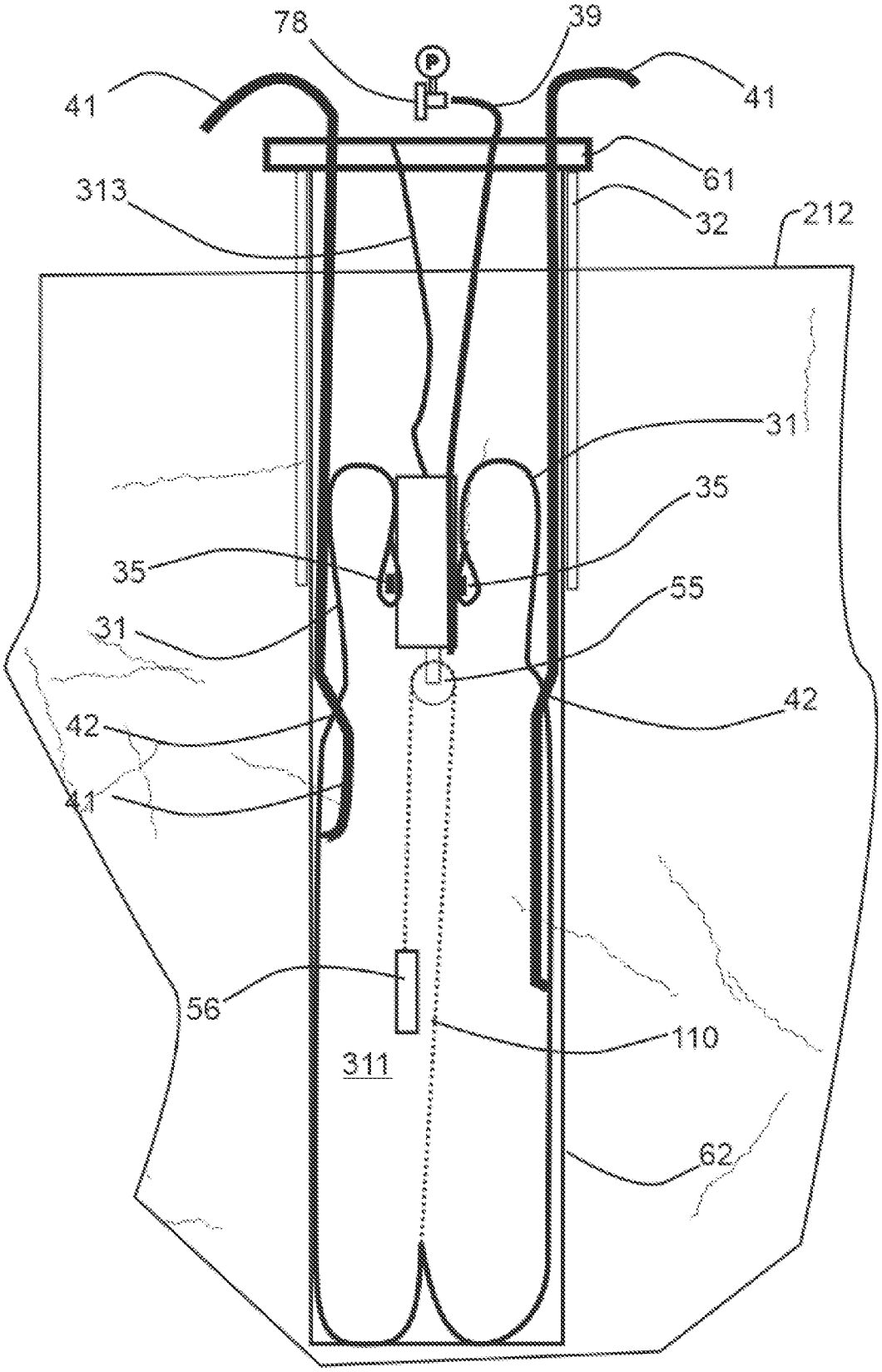
FIG. 7 is a side sectional view of the system seen in FIG. 6, showing the system at a second subsequent configuration for augmenting the excess head in the water-filled borehole liner.

FIG. 7 shows the positional configuration of the system after the sealing wellhead 34 and hanging weight 56 have lowered a distance to maintain a pressure within the liner interior 311, and thus to maintain the uniform pressure differential holding the liner 31 against the borehole wall. The system configuration of FIG. 7 accordingly corresponds conceptually to the second system configuration illustrated by phantom lines in FIG. 3. It is seen therefore that lowering the sealing wellhead 34, by controlled use of the safety tether 313 and from an upper first position to a lower second position, presses down the upper end of the liner to dilate the liner against the borehole 62. The sealing wellhead 34 has moved from a first position, as seen in FIG. 6, to the second lower position seen in FIG. 7, so as to maintain at the required amount the pressure differential across the liner 31. (The elevational difference between the position of FIG. 6 and the position of FIG. 7 has been exaggerated for illustrative emphasis.) It is evident with combined reference to FIGS. 6 and 7 that an operator at the surface 212 may controllably raise or lower the safety tether 313 to selectively raise or lower the sealing wellhead 34 and hanging weight 56, and thereby modulate the pressure within the liner interior 311 as needed.

A further advantage of this system is that the weight tether 110 is supported in the borehole 62 and does not need a feed-through in the wellhead. The effect of the tether hanging weight 56 can be enhanced by supplying an additional sheave (in cooperation with first sheave 55) engaged with the tether 110 itself, and an additional sheave to the bottom of the sealing wellhead 34, similar to configuring a block and tackle, to quadruple the downward force of the hanging weight 56. But such an increase is not usually needed.

In the circumstance of liner leakage over time, the interior volume of the liner decreases, and the weighted sealing wellhead 34 descends, thereby maintaining the desired overpressure within the liner 31. It is seen, therefore, that a small water loss (and pressure decrease) from the liner interior 311 results in an automatic, concurrent, descent of the sealing wellhead 34, which descent generates a corresponding compensative increase in the differential pressure across the liner 31 to maintain the needed overpressure. Then, if desired in the judgment of the operator, a controlled addition of water to the liner interior 311 through the water addition tube 39 increases the liner's interior water volume, and raises the weighted sealing wellhead 34 back to its original position nearer the surface 212. A major advantage of the system and method is that a modest descent of the sealing wellhead 34 can offset the leakage of any water from within the liner 31.

The pressure increase obtained by operation of this apparatus and technique is deduced from the relationship between the driving pressure of an everting liner and the tension developed on the inverted portion of the liner. As mentioned in reference to FIG. 3, The tension on the inverted bottom portion of an everting liner is well known from the approximate relationship of $T=\frac{1}{2}A\,\Delta P$, where A is the cross-sectional area of the liner and ΔP is the differential pressure across the end of the liner. Now if T is considered the weight of the sealing wellhead 34 and sheave 55, plus the weight of the hanging weight 56, then the increase in pressure developed by this system is:

$$\Delta P=2(WH+2w)/A,$$

where WH is the heavy sealing wellhead 34 weight and w is the weight of the hanging weight 56 on the weight tether 110 (minus the buoyancy of the wellhead 34 and hanging weight 56). It is noted that a larger pressure increase is possible by decreasing the surface casing cross section. The differential pressure enhancement can be adjusted using these variables. In some situations, it may be desirable to add a heavy mud column in the very bottom end of the liner 31 to prevent the bottom end of the liner being inverted by the hanging weight 56 on the weight tether 110.

For a liner with sample tubing 41 extending from water sampling ports 111 as seen in FIG. 1, the sampling tubes 41 of FIGS. 6 and 7 must be routed through the liner 31 as shown at the feed-throughs 42 for each tube 41 to lie outside the liner. If the liner is only a blank liner (no sampling tubes), the feed-throughs 42 are not needed. If employed, the feed-throughs preferably are defined in the liner at a depth approximately 15 feet below the ground surface 212.

This pressure enhancement and maintenance in a liner can be used in the submerged small pipe of U.S. Pat. No. 9,797,22; a small liner can be emplaced in the submerged small pipe of that patent, which is incorporated herein by reference. In that method, increasing the pressure in the liner will both force the heavy mud into the bottom end of the small pipe, and also lift the heavy liner weight at the top of the pipe as described herein. The combined heavy mud in the bottom of the small pipe and the heavy weight in the inverted liner at the top of the pipe will increase the differential pressure in the liner. Furthermore, the use of the weight in the inverted liner in the small submerged pipe may avoid the need for the mud in the bottom of the borehole liner of U.S. Pat. No. 9,797,22. That system and apparatus still requires a sealing wellhead with feed throughs for the interior tubes of the liner.

In summary, this system of a sealed liner 31 suspending a hanging weight from the inverted top, upper, sealed 35 end of the liner enhances the normal hydraulic head in the interior 311 of the fluid-filled liner. Adjustments to the hanging weight geometry and the cross section of the borehole at the top and bottom end can change the effect of the basic geometry on the interior liner pressure. The method and system thus may be exploited to overcome the problem of sealing boreholes under artesian conditions.

Although the invention has been described in detail with particular reference to these preferred embodiments, other embodiments can achieve the same results. The present invention can be practiced by employing conventional materials, methodology and equipment. Accordingly, the details of such materials, equipment and methodology are not set forth herein in detail. In the previous description, specific details are set forth, such as specific materials, structures, chemicals, processes, etc., in order to provide a thorough understanding of the present invention. However, as one having ordinary skill in the art would recognize, the present invention can be practiced without resorting to the details specifically set forth. In other instances, well known processing structures have not been described in detail, in order not to unnecessarily obscure the present invention.

Only some embodiments of the invention and but a few examples of its versatility are described in the present disclosure. It is understood that the invention is capable of use in various other combinations and is capable of changes or modifications within the scope of the inventive concept as expressed herein. Modifications of the invention will be obvious to those skilled in the art and it is intended to cover in the appended claims all such modifications and equivalents.

I claim:

1. A method for increasing pressure within the interior of a flexible liner in a borehole below the ground's surface to seal the borehole, the liner having a top end and an interior containing water, the method comprising:

disposing a weighted sealing wellhead into the top end of the liner;

providing a seal between the top end of the liner and around the outside of the sealing wellhead;

lowering, into the borehole and with a main tether, the sealing wellhead toward the liner interior;

inverting the liner top end with the sealing wellhead to decrease a liner interior volume and increase pressure within the liner interior.

2. The method of claim 1 further comprising the step of everting the liner down the borehole before disposing the weighted sealing wellhead into the top end of the liner.

3. The method of claim 1, wherein when water leaks from the liner interior to the liner exterior, the sealing wellhead descends in the borehole to invert further the liner top end thereby decreasing further the liner interior volume to maintain an overpressure sufficient to sustain a seal of the borehole by the liner.

4. The method of claim 3 further comprising:

defining a hole in a lower wall of the sealing wellhead, below the seal between the liner and the wellhead, through which water may flow between an interior of the sealing wellhead and the liner interior;

providing a water addition tube from the ground's surface to the interior of the sealing wellhead; and adding or removing water from the liner interior, via the interior of the sealing wellhead and the water addition tube.

5. The method of claim 4 further comprising:

attaching a sheave or looped structure to a bottom of the sealing wellhead;

disposing a hanging weight within the liner interior below the sealing wellhead;

securing a weight tether to a bottom end of the liner, and disposing the weight tether through the sheave or looped structure; and attaching the weight tether to a top end of the hanging weight;

wherein the hanging weight increases a weight applied to the top end of the liner.

6. A system for increasing pressure within the interior of a flexible liner everted in a borehole below the ground's surface, the liner having a closed bottom end and a top end and being substantially filled with water, the system comprising:

a weighted sealing wellhead situated within the borehole;

a sheave or looped structure attached to a bottom of the sealing wellhead;

a water addition tube extending from the surface and to or through the sealing wellhead for adding water to the liner interior via the sealing wellhead;

means for sealing the top end of the liner to the outside of the sealing wellhead thereby to close the top end;

a hanging weight disposed within the liner interior below the sealing wellhead; and a weight tether secured to the bottom end of the liner and disposed through the sheave or looped structure, and attached to a top end of the hanging weight;

wherein the sealing wellhead and the hanging weight are movable downwardly in the borehole to decrease a liner interior volume to increase the pressure within the liner interior.

7. A system for increasing pressure within the interior of a flexible liner everted in a borehole below the ground's surface, the liner having a closed bottom end and a top end and being substantially filled with water, the system comprising:

a sealing wellhead situated within the borehole;

a sheave or looped structure attached to a bottom of the sealing wellhead;

a water addition tube extending from the surface and to or through the sealing wellhead for adding water to the liner interior via the sealing wellhead;

a clamp which seals a portion of the liner near its top end to the sealing wellhead;

a hanging weight disposed within the liner interior below the sealing wellhead; and a weight tether secured to the bottom end of the liner and disposed through the sheave or looped structure, and attached to a top end of the hanging weight;

wherein the sealing wellhead is movable downwardly in the borehole to increase the pressure within the liner interior.

* * * * *